United States Patent [19]

Van-Hee et al.

[11] 3,989,415

[45] Nov. 2, 1976

[54] SILENCING HOUSING FOR A MACHINE PLANT

[75] Inventors: Michel Van-Hee, Kontic; Henri Ysewijn, Antwerp, both of Belgium

[73] Assignee: Atlas Copco Aktiebolag, Huddinge, Sweden

[22] Filed: Aug. 26, 1974

[21] Appl. No.: 500,201

[30] Foreign Application Priority Data

Aug. 27, 1973 Sweden ..... 7311576

[52] U.S. Cl. ..... 417/312; 181/33 K

[51] Int. Cl.[2] ..... F04B 21/00

[58] Field of Search ..... 123/195 C, 198 R, 198 E; 417/312, 313; 181/33 K

[56] References Cited

UNITED STATES PATENTS

| | | | |
|---|---|---|---|
| 3,478,958 | 11/1969 | Hinck et al. | 181/33 K |
| 3,642,092 | 2/1972 | Cederbaum | 181/33 K |
| 3,815,965 | 6/1974 | Ostwald | 181/33 K |
| 3,856,439 | 12/1974 | Moehrbach | 181/33 K |

FOREIGN PATENTS OR APPLICATIONS

| | | | |
|---|---|---|---|
| 1,521,057 | 4/1968 | France | 181/33 K |
| 1,577,688 | 6/1969 | France | 181/33 K |
| 357,147 | 9/1931 | United Kingdom | 181/33 K |

*Primary Examiner*—Wendell E. Burns
*Assistant Examiner*—David D. Reynolds
*Attorney, Agent, or Firm*—Eric Y. Munson

[57] ABSTRACT

A silencing housing for enclosing a machine plant having at least one external cooler, for instance a compressor unit, which housing being divided into a primary chamber for accomodating the machine and a secondary chamber communicating with said primary chamber. Within the secondary chamber there are located a cooler and a ventilator. The ventilator is arranged to accomplish a ventilating air flow through the primary chamber as well as an air flow through the cooler within the secondary chamber. To this end the primary chamber is provided with one air inlet opening and the secondary chamber is provided with one air inlet opening and one air outlet opening. For adapting the housing to a machine plant having two external coolers it is provided with a tertiary chamber as well wherein the additional cooler is disposed. A second ventilator is arranged to establish an air flow through the additional cooler, which air flow extends out of the housing through an air outlet opening disposed in said tertiary chamber. All air in- and outlet openings of the housing being provided with sound traps.

7 Claims, 4 Drawing Figures

SILENCING HOUSING FOR A MACHINE PLANT

This invention relates to a silencing housing for a machine plant. More particularly, the invention relates to a silencing housing intended for inclosing a machine plant provided with at least one external cooler, for instance an internal combustion engine or a compressor provided with an intermediate cooler or both.

When enclosing a machine plant in a completely surrounding housing there is a problem in obtaining an effective cooling of the machine plant.

The present invention intends to solve this problem by establishing at least two separate air flows through the housing, one for direct cooling of the external cooler and one for ventilating the housing. To this end, the housing is divided into a primary chamber for accomodating the machine plant and a secondary chamber within which are disposed the external cooler and a ventilator as well as an air outlet opening which is common to both chambers.

Alternatively, the housing can be provided with a tertiary chamber for accomodating a second cooler and a second ventilator, wherein the latter is arranged to establish a separate air flow through the second cooler.

BRIEF DESCRIPTION OF THE DRAWINGS

Embodiments of the invention are described in detail with reference to the enclosed drawings on which

DETAILED DESCRIPTION OF THE PREFERRED EMBODIMENTS

Figure 1:
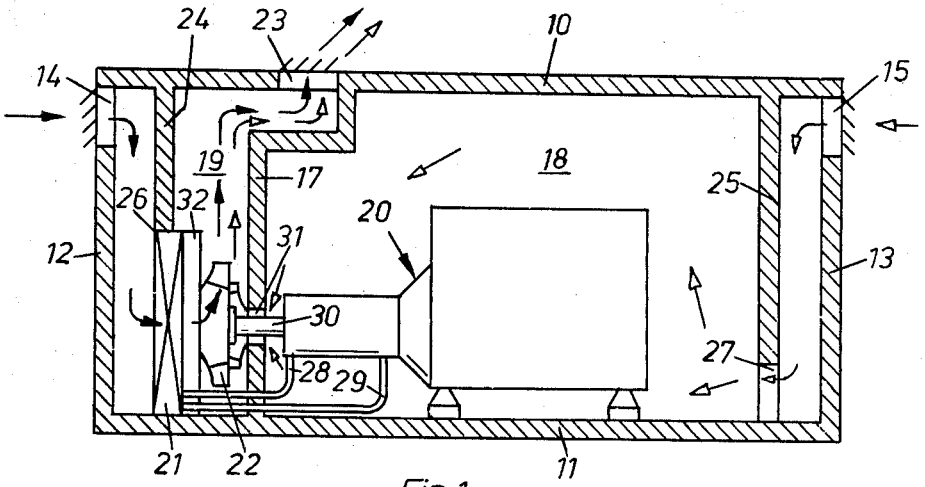
FIG. 1 shows a longitudinal section through a housing according to the invention which housing accomodates a machine plant provided with one external cooler.

The housing shown in FIG. 1 consists of two longitudinal side walls, a roof 10, a bottom 11 and two end walls 12 and 13 which are provided with air inlet openings 14 and 15, respectively. Within the housing there is arranged a transverse partition wall 17 by which the housing is divided into a primary chamber 18 and a secondary chamber 19. The primary chamber occupies the main part of the housing and accomodates a machine plant 20.

Within the secondary chamber, there are arranged a cooler 21 and a ventilator 22, the task of which is to accomplish an air circulation through the housing and the cooler. Further, the secondary chamber 19 is provided with an air outlet opening 23 which is located in the roof 10 of the housing.

The primary and the secondary chambers are provided with partition walls 24 and 25 respectively, the object of which is to overlap the air inlet openings 14 and 15 and thereby form sound traps for preventing noise from piercing to the ambient. The wall 25 is provided with an air passage opening 27 and the wall 24 is provided with an opening 26 at which the cooler 21 is located.

Moreover, two conduits 28, 29 are connected to the machine plant for circuiting coolant medium to the cooler 21. The ventilator 22 is mounted on a shaft 30 which extends through an aperture 31 in the partition wall 17.

The ventilator 22, as shown in FIG. 1, is of the radial flow type and of a double design and is arranged to simultaneously suck air from the cooler 21 and from the primary chamber 18. For this purpose the aperture 31 is dimensioned so as to form an annular air passage around the shaft 30. In order to direct the air into the ventilator from the cooler the housing is provided with a baffle means 32 for guiding the air flow toward the axial inlet of the ventilator 22. The baffle means 32 could very well be made of sheet steel.

The air transport through the housing according to FIG. 1 is the following. The double ventilator 22 sucks air from two directions and blows it out into the secondary chamber 19 and further out to the atmosphere through the opening 23. In this manner there is obtained a flow of air which enters the secondary chamber 19 through the inlet opening 14, passes the cooler 21 and leaves the housing through the opening 23. (Illustrated by filled arrows). There is also obtained a ventilation air flow which enters the primary chamber 18 through the inlet opening 15, passes through the opening 27 of the partition wall 25 and leaves the primary chamber 18 through the aperture 31. (Illustrated by unfilled arrows). By this arrangement atmosperic air is used for primary cooling as well as for ventilation, which means that the lowest possible initial temperature of the cooling air is obtained for both of these purposes.

Figure 2:
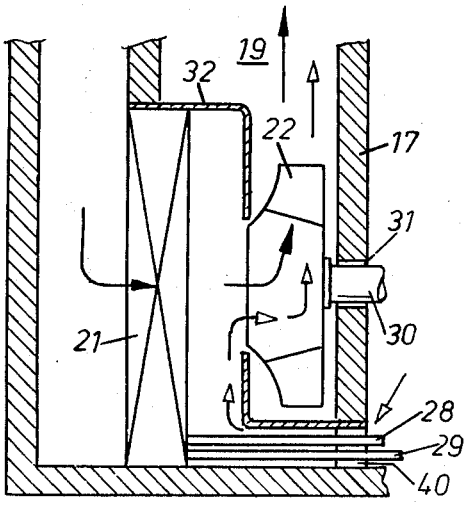
FIG. 2 shows, in larger scale, an alternative design of the cooler and ventilator arrangement in a housing according to FIG. 1.

In FIG. 2 there is shown an alternative air supply to the ventilator 22. In this case the aperture 31 is dimensioned so as to let through the shaft 30 without leaving an air passage opening. Instead there is an opening 40 left around the conduits 28 and 29 through which opening air from the primary chamber may flow into the secondary chamber upstream of the ventilator but downstream of the cooler 21. This means that a single radial flow ventilator can be used and that the primary cooling air flow as well as the ventilation air flow is sucked from the same direction into the ventilator for transportation to the atmosphere through the opening 23.

Figure 3:
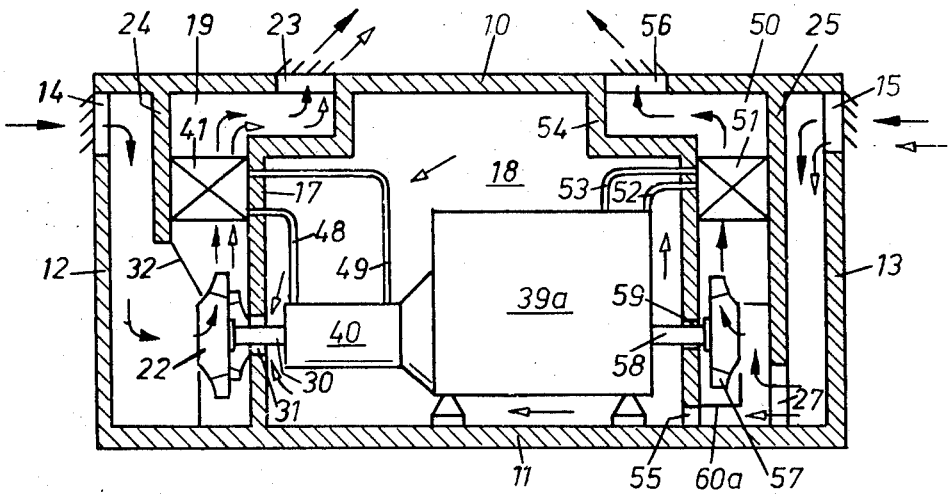
FIG. 3 shows a longitudinal section through a housing according to the invention adapted to a combustion engine powered compressor, wherein the compressor as well as the combustion engine are provided with an external cooler.

In FIG. 3 there is shown a silencing housing which has been adapted to a combustion engine powered machine plant, wherein the engine **39*a* as well as the driven part 40, for instance a compressor, are provided with external coolers. In the same way as in the embodiment according to FIG. 1, the housing according to this embodiment is divided into a primary chamber 18 and a secondary chamber 19 but in addition thereto the housing comprises a tertiary chamber 50 in which a second external cooler 51 is located. This is connected to the engine 39*a* through conduits 52 and 53**.

In this embodiment too, a ventilator 22 and a first cooler 41 are located in the secondary chamber 19 and the ventilator is arranged to establish a cooling air flow through the cooler 41 as well as a ventilation air flow through the primary chamber 18. However, according to the embodiment in FIG. 3, the cooler 41 within the secondary chamber has been located downstream of the cooling ventilator 22, whereby the air flow which is directly sucked into the secondary chamber 19 as well as the ventilation flow from the primary chamber 18 are conducted through this cooler 41. The cooler 41 is connected to the compressor 40 through conduits 48 and 49.

In order to form the tertiary chamber 50, the housing is provided with another partition wall 54 which together with the partition wall 25 defines the tertiary chamber 50. The wall 25 has been described in connection with the previous embodiment and the purpose thereof is to establish a sound baffle inside the inlet opening 15. The partition wall 54 has an opening 55 through which the air flow for the primary chamber 18 can pass. The tertiary chamber 50 is also provided with an air outlet opening 56 which is located in the roof 10 of the housing.

Within the tertiary chamber 50 there is arranged a ventilator 57 of the radial flow type which is powered directly by the engine 39*a* via a shaft 58. The shaft 58 extends through an opening 59 in the wall 54. At the low pressure side of the ventilator 57 there is arranged a shield 60*a*, for instance made of sheet steel, for directing entering air toward the central inlet of the ventilator 57.

As being apparent from FIG. 3, not only the ventilation air of the primary chamber 18 but also the air which is going to pass the tertiary chamber 50 is sucked in through the air inlet opening 15 in the end wall 13 of the housing. After having passed the sound trap forming wall 25 the entering air flow is divided in such a way that one part thereof passes into the tertiary chamber 50 in order to absorb heat from the cooler 51 while the other part thereof passes into the primary chamber 18 for establishing ventilation thereof.

Figure 4:
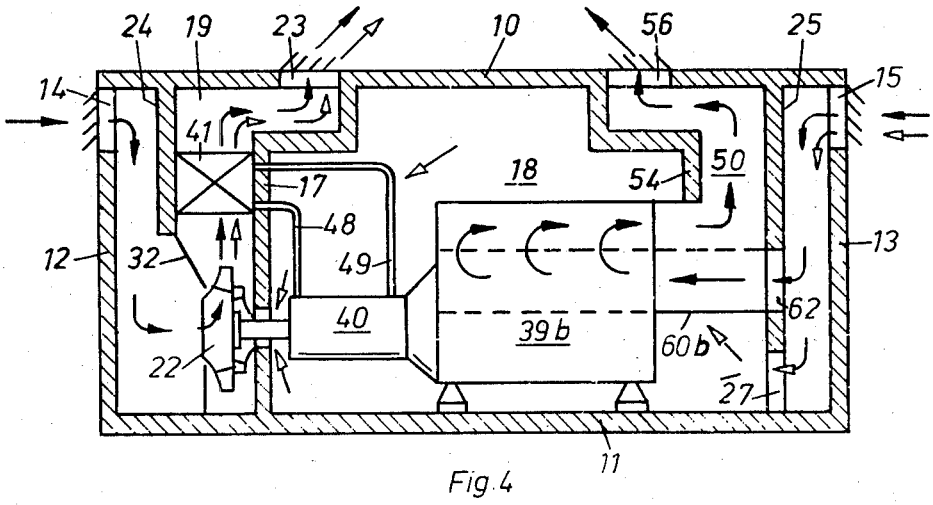
FIG. 4 shows a longitudinal section through a silencing housing according to the invention adapted to a combustion engine powered compressor, wherein the compressor has an external cooler while the combustion engine has an internal primary cooling fan.

In FIG. 4 there is shown still another silencing housing according to the invention. This is an alternative to the embodiment shown in FIG. 3 in that it is adapted to an air-cooled combustion engine provided with an internal primary cooling fan and because of that it lacks an external cooler.

According to this embodiment, the wall 25 is provided with a separate air opening 62 which through a duct 60*b* connects the air inlet opening 15 to the primary cooling fan (not shown) of the engine 39*b*. Consumed primary cooling air is conducted away from the engine through the tertiary chamber 50 and the outlet opening 56 to the atmosphere. So, in this case the air which enters the housing is, before passing the wall 25, divided into one ventilation flow intended for the primary chamber 18 of the housing and one primary cooling air flow intended for the engine 39*b*.

The invention is not limited to the shown and described embodiment but can be freely varied within the scope of the claims.

What we claim is:

1. A silencing housing for surrounding a machine having at least one external cooler comprising:

enclosing means defining a primary chamber and a secondary chamber, the primary chamber and secondary chamber communicating with one another, the primary chamber enclosing the machine, the enclosing means having a plurality of air inlet opening means and at least one air outlet opening means, The opening means being provided with sound trapping means, the secondary chamber containing the machine cooler, the secondary chamber having at least one of the air inlet opening means and the outlet opening means of the enclosing means, the primary chamber having at least one of the air inlet opening means, and ventilator means disposed within the secondary chamber for conveying air from the inlet opening means in both chambers to the outlet opening means in a manner such that the air entering the secondary chamber through the opening means therein is caused to pass through the cooler.

2. A silencing housing according to claim 1, wherein the cooler is located upstream of the ventilator and the ventilator is arranged to convey air from the air inlet opening means of the primary chamber parallel with the air from the air inlet opening means of the secondary chamber, and only the air flow from the air inlet opening of the secondary chamber is brought to pass through the cooler.

3. A silencing housing according to claim 1 wherein the cooler is located downstream of the ventilator and air from the inlet opening means of the secondary as well as the primary chamber is brought to pass through the cooler.

4. A silencing housing according to claims 1 wherein the ventilator is of the radial flow type and is powered by the machine through a shaft extending through a wall which separates the primary and secondary chambers.

5. A silencing housing according to claim 4, wherein the primary and secondary chambers communicate with each other through an opening in the paritition wall, which opening surrounds the shaft.

6. A silencing housing according to claim 1 wherein the machine is a combustion engine powered compressor, the combustion engine as well as the compressor are provided with external coolers and the compressor cooler is located within the secondary chamber further comprising a tertiary chamber defined by the enclosing means and having at least one air outlet opening means, the tertiary chamber contaning the combustion engine cooler and a ventilator for conveying air from the air inlet opening means of the primary chamber to the air outlet opening means of the tertiary chamber with passage through the cooler of the combustion engine.

7. A silencing housing according to claim 1 wherein the machine is a combustion engine powered compressor and the combustion engine is provided with an internal primary cooling fan, further comprising a tertiary chamber which is provided with an air outlet opening means and which is arranged to lead consumed primary cooling air from the combustion engine to the atmosphere.

* * * * *

UNITED STATES PATENT OFFICE

CERTIFICATE OF CORRECTION

Patent No. 3,989,415 Dated November 2, 1976

Inventor(s) Michel Van-Hee; Henri Ysewijn

It is certified that error appears in the above-identified patent and that said Letters Patent are hereby corrected as shown below:

[73] Assignee: Atlas Copco Aktiebolag, Nacka, Sweden

Signed and Sealed this

Third Day of May 1977

[SEAL]

*Attest:*

RUTH C. MASON
*Attesting Officer*

C. MARSHALL DANN
*Commissioner of Patents and Trademarks*